US006369018B1

(12) United States Patent
Hsu et al.

(10) Patent No.: US 6,369,018 B1
(45) Date of Patent: Apr. 9, 2002

(54) PROCESS FOR PREPARING POURABLE, TRANSPARENT/TRANSLUCENT LIQUID DETERGENT WITH NON-CONTINUOUS SUSPENDING SYSTEM

(75) Inventors: Feng-Lung Gordon Hsu, Tenafly; Daniel Joseph Kuzmenka, Wood-Ridge; Dennis Stephen Murphy, Leonia; Kristina Marie Neuser, Cliffside Park; Myongsuk Bae-Lee, Montville; Kim Garufi, Cliffside Park; Deborah Coccaro, Colonia, all of NJ (US)

(73) Assignee: Unilever Home & Personal Care, USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/723,360

(22) Filed: Nov. 27, 2000

Related U.S. Application Data

(63) Continuation of application No. 09/213,047, filed on Dec. 16, 1998, now Pat. No. 6,258,771.

(51) Int. Cl.[7] ..... C11D 3/22

(52) U.S. Cl. ..... 510/418; 510/470; 510/336; 510/370; 510/396; 510/473

(58) Field of Search ..... 510/193, 221, 510/336, 361, 370, 396, 397, 404, 418, 463, 470, 471, 473

(56) References Cited

U.S. PATENT DOCUMENTS

| | | | | |
|---|---|---|---|---|
| 2,379,942 | A | 7/1945 | Webber | 173/328 |
| 2,503,280 | A | 4/1950 | Lockwood | 260/513 |
| 2,507,088 | A | 5/1950 | Bradley | 260/513 |
| 3,060,124 | A | 10/1962 | Ginn | 252/135 |
| 3,260,741 | A | 7/1966 | Mackinnon | 260/513 |
| 3,308,067 | A | 3/1967 | Diehl | 252/161 |
| 3,372,188 | A | 3/1968 | Alston | 260/503 |
| 3,630,929 | A | 12/1971 | van Dijik | 252/136 |
| 3,649,455 | A | 3/1972 | Abe et al. | 195/66 |
| 4,062,647 | A | 12/1977 | Strom et al. | 8/137 |
| 4,090,973 | A | 5/1978 | Maguire, Jr. et al. | 252/89 |
| 4,260,528 | A | 4/1981 | Fox et al. | 252/525 |
| 4,316,812 | A | 2/1982 | Hancock et al. | 252/99 |
| 4,474,818 | A | 10/1984 | Scott | 424/358 |
| 4,489,512 | A | 12/1984 | Schovee | 40/154 |
| 4,497,718 | A | 2/1985 | Neiditch et al. | 252/8.75 |
| 4,556,510 | A | 12/1985 | Holsopple | 252/547 |
| 4,581,042 | A | 4/1986 | Willmore | 51/293 |
| 4,749,512 | A | 6/1988 | Broze et al. | 252/174.18 |
| 4,810,414 | A | 3/1989 | Huge-Jense et al. | 252/174.12 |
| 5,047,167 | A | 9/1991 | Steyn et al. | 252/160 |
| 5,057,241 | A | 10/1991 | Merritt et al. | 252/174.17 |
| 5,147,576 | A | 9/1992 | Montague et al. | 252/174 |
| 5,281,355 | A | 1/1994 | Tsaur et al. | 252/174.13 |
| 5,281,356 | A | 1/1994 | Tsaur et al. | 252/174.13 |
| 5,393,450 | A | 2/1995 | Shana'a | 252/170 |
| 5,494,602 | A | 2/1996 | Thomaides et al. | 252/174.17 |
| 5,534,265 | A | 7/1996 | Fowler et al. | 424/489 |
| 5,562,939 | A | 10/1996 | Lewis | 426/250 |
| 5,589,370 | A | 12/1996 | Ratuiste et al. | 264/4.3 |
| 5,597,790 | A | 1/1997 | Thoen | 510/303 |
| 5,733,854 | A | 3/1998 | Chowdhary et al. | 510/121 |
| 5,750,489 | A | 5/1998 | Garcia et al. | 510/417 |
| 5,853,430 | A | 12/1998 | Shindo et al. | 8/137 |
| 5,880,076 | A | 3/1999 | Vermeer | 510/123 |

FOREIGN PATENT DOCUMENTS

| | | |
|---|---|---|
| EP | 100 125 | 2/1984 |
| EP | 170 927 | 2/1986 |
| EP | 258 068 | 3/1988 |
| GB | 401 413 | 11/1933 |
| GB | 461 221 | 2/1937 |
| GB | 1 303 810 | 1/1973 |
| GB | 1 429 143 | 3/1976 |
| GB | 1 470 250 | 4/1977 |
| NL | 154269 | 1/1970 |
| WO | 95/31528 | 11/1995 |
| WO | 97/26315 | 7/1997 |

OTHER PUBLICATIONS

PCT International Search Report in a PCT application PCT/EP 99/09033.

*Primary Examiner*—Cynthia H. Kelly
*Assistant Examiner*—Dawn Garrett
(74) *Attorney, Agent, or Firm*—Rimma Mitelman

(57) ABSTRACT

A process for making a transparent/translucent HDL composition capable of suspending relatively large size particles while remaining readily pourable. The composition is stable, even in the presence of relatively large amounts of electrolyte/surfactants.

11 Claims, No Drawings

PROCESS FOR PREPARING POURABLE, TRANSPARENT/TRANSLUCENT LIQUID DETERGENT WITH NON-CONTINUOUS SUSPENDING SYSTEM

This is a continuation of Ser. No. 09/213,047 filed Dec. 16, 1998 now U.S. Pat. No. 6,258,771.

BACKGROUND OF THE INVENTION

1. Field of the Invention

The present invention relates to a process for manufacturing transparent or translucent heavy duty liquid laundry detergent compositions containing polymer or polymers (e.g., polymer gums) capable of suspending relatively large size particles while remaining readily pourable (good shear thinning properties). The suspended particles generally comprise a component subject to degradation (e.g., encapsulated enzyme and/or bleach) and/or a component not soluble in heavy duty liquid and which causes an opaque appearance. Through careful selection of polymer/polymers, it is possible to find a polymer suspending system stable in ionic (e.g., high surfactant) environment and which simultaneously provides consumer desirable appearance. Through unique processing of polymer(s), the above-noted properties can be achieved. In particular, the present invention is concerned with formation of a non-continuous network suspending system.

2. Background

For a variety of reasons, it is often greatly desirable to suspend particles in heavy duty liquid detergent compositions. For example, because there are certain components (e.g., bleaches, enzymes, perfumes) which readily degrade in the hostile environment of surfactant containing heavy duty liquids, these components can be protected in capsule particles (such as described, for example, in U.S. Pat. Nos. 5,281,355 and 5,281,356 both to Tsaur et al., hereby incorporated by reference into the subject application) and the capsule particles may be suspended in the heavy duty liquid detergents. Other particles which may be suspended include enzymes (whether or not encapsulated) and other desirable ingredients (e.g., aminosilicone oil, PVP, soil release agents, anti-redeposition agents, antiwrinkle agents etc.)

One way to suspend particles in liquid compositions is to use so-called "structured" heavy duty liquids (sometimes referred to in the art as "duotropic" liquids and in contrast to single continuous phase "isotropic" liquids). Structured liquids may be broadly characterized in that they contain high levels of electrolyte and in that the liquids form so-called lamellar layers which are like sheets or plates in close proximity to one other. Structured liquids are well defined in U.S. Pat. No. 5,147,576 to Montague et al., hereby incorporated by reference into the subject application. Such structured liquids, by virtue of their close packing and lamellar sheets, are generally able to suspend particles (e.g., capsules, enzymes, polymers) more readily than isotropic liquids. Structured liquids are often difficult to pour and, because they are lamellar, are generally, if not always, opaque.

Another way of suspending particles in liquids is through the use of certain structuring gums (e.g., xanthan gum, rhamsan gum and the like). While such gums are desirably used to structure liquids and suspend particles, however, they are notoriously susceptible to electrolytes (e.g., surfactants) present in the compositions and so may generally only be used when the level of surfactant is severely limited (e.g., less than 10% by wt.). By contrast, compositions of the present invention comprise greater than 15%, preferably greater than 17% most preferably 20–85% by wt. surfactant. Use of polymer gums and such levels of surfactant is known to lead to instability precipitation which in turn leads to non-clear product and phase separation.

Moreover, when used to thicken compositions, the gum polymers are generally used in such high amounts as to render the compositions very difficult to pour. By difficult to pour is meant less than about 3000 cps at $21S^{-1}$ shear rate measured at room temperature (measurements of invention were made using Haake RV20 Rotovisco RC20 Rheocontroller; preferred sensor systems were MV1, MV2 and MV3 sensor systems).

As far as applicants are aware, all attempts to suspend particles, particularly large size particles (e.g., 300 to 5000 microns, preferably 500 or greater to 3000 microns), in liquid compositions, particularly those containing greater than 15% surfactant, while maintaining processability have been unsuccessful.

U.S. Pat. No. 4,749,512 to Brown et al., for example, teaches suspension of builder salts in automatic dishwashing formulations. The compositions are neither translucent nor transparent. The compositions also contain no water and no polymeric thickeners. The builders are suspended due to surfactant structuring.

U.S. Pat. No. 5,562,939 to Lewis teaches a method using a pre-gel process to suspend particles in liquid. The compositions have no surfactant and a pH of 2.5 to 6, preferably 3.0 compared to much higher surfactant levels and pH (about 6 to 13, preferably 8 to 10) of the subject invention.

U.S. Pat. No. 5,597,790 to Thoen teaches suspension of solid peroxygen compounds having particle size of 0.5 to 20 microns in liquid detergents using low levels of silicate. The suspended particles were much smaller than those of the invention.

Finally GB 1,303,810 discloses clear liquid medium and a visually distinct component of at least 0.5 millimeter particle size. However where more than 10% surfactant is used, only clays, not gums are used to structure. Where a gum is used to structure (Kelzan), no more than 10% surfactant is used.

In short, there is no teaching in the art of heavy duty liquid compositions containing 15% or greater, preferably about 20% to 85% surfactant, more preferably 21% to 75% comprising suspending gum polymers stable in high surfactant environment (e.g., don't phase separate and cause opaqueness) able to suspend large size particles and simultaneously provide translucent/transparent, pourable compositions.

While not wishing to be bound by theory, it is believed these compositions can be formed only because of applicants realization that the suspending polymers (e.g., gums) must be given sufficient time or heat to swell, preferably while not in the presence of surfactant or electrolyte (e.g., surfactant or electrolyte may compete for water preventing water gain by the gum).

The swollen polymer/gum (wherein degree of swelling may be measured using in indicators or other techniques known to those skilled in the art) can then be formed into "suspension bits" by agitation of polymer gum solution in combination with a chemical or mechanical means selected from the group consisting of addition of counterion (e.g., causing polymer gum aggregation); temperature effect (e.g., temperature causing change in polymer gum); or mixtures thereof. Detergent base may be separately formed and added to preformed "bits" to form a "non-continuous" aggregation of gum particles sufficient to form a suspending network; or surfactant and other final detergent component may be added to a polymer gum solution to form suspending particles in situ. Although this in situ method may comprise addition of counterion to form "bits" while surfactant is being slowly added, depending on gum selection, it is possible to practice this method with no counterion addition as well.

In any event, because a pre-swollen polymer gum solution is first formed without surfactant competition (e.g., for water), surprisingly and unexpectedly it has been found possible to form a transparent/translucent liquid detergent system which suspends large size particles and is readily pourable. Moreover, the suspending polymer gums are not susceptible to ionic agents and/or surfactants and can form these transparent particle suspending function in a high surfactant environment without precipitating to form opaque depositions or phase separate. This is completely novel to the art as far as applicants are aware.

The subject invention is directed to selection of specific gums and formation of non-continuous network suspending system while a companion case is directed to selection of specific gums to form a "continuous" suspending network.

BRIEF DESCRIPTION OF THE INVENTION

The present invention provides a process for manufacturing an easy pouring (highly, shear thinning), transparent or translucent heavy duty liquid composition capable of suspending particles in the range of 300 to 5000 microns in size, even in the presence of high surfactant and/or electrolyte concentration. The process comprises:

(1) first forming a polymer gum solution (i.e., premix) by mixing 0.01 to 5% by wt. of gum premix of certain suspending polymer or polymer gums (e.g., selected from the group consisting of carrageenans, gellans, agars) with balance water at a temperature of from room temperature to about 200° F. for at least 30 minutes or until gum is fully swollen depending on gum selection (for hygiene purposes, it is preferable to heat to at least 150° F. for at least 30 minutes) in order to form a polymer gum premix having concentration of 0.001 to 5% by weight total composition;

(2) promoting the formation of gum "bits" from the polymer gum solution by agitating the gum solution and additionally selecting method selected from the group consisting of:
   (a) addition of counterion to form agglomeration of "bits" from polymer gum solution;
   (b) utilization of temperature differentials to form "bits" from polymer gum solution; and
   (c) mixtures thereof; and (3) separately forming a detergent base which is subsequently combined with the gum bits (i.e., base can be added to bits or bits can be added to base) formed from step (2) to form a final detergent composition having suspended gum bits; or
   (1) going through step (1) as outlined above to form polymer gum solution; and
   (2) contacting a detergent base (either fully or partially formed) with polymer gum solution of step (1) to form a final detergent base composition with suspended polymer bits (e.g., polymer bits forming slowly in situ as detergent components or full detergent pre-mix are added).

It must be noted, however, that critical to formation of network is formation of polymer gum solution (step (i)) in absence of substantial amounts of surfactant or electrolyte (e.g., small amounts of said surfactant or electrolyte may exist when gum is purchased). As noted, this is believed to be required so that polymer may swell (e.g., with water) without having to compete for the surfactant's or electrolyte's attraction for water.

The present invention is particularly directed to use of specific gums which will form non-continuous network suspending gums in contrast to other gums (e.g., xanthan gum), described in applicants copending application, which generally are used to form a "continuous" network.

DETAILED DESCRIPTION OF THE INVENTION

The invention comprises a process for making an easy pouring (pour viscosity of about 50 to 3000 cps of $21S^{-1}$, preferably 100 to 1500 cps, more preferably 150 to 1000 measured at room temperature) transparent or translucent heavy duty liquid composition (preferably isotropic when viewed macroscopically) wherein a polymer or mixture of polymers (i.e., gums) are used to stably suspend relatively large size particles even in the presence of relatively large amounts of surfactant/electrolyte. Applicants are unaware of any liquid composition capable of suspending such large size particles in a transparent /translucent composition while retaining good pourability and stability.

In particular, the invention is directed to specific gums (e.g., carrageenan, gellan, agar, gelatin) and combinations of these gums with other materials which will form a so-called "non-continuous" suspending network wherein the non-continuous gum bits aggregate to form a suspending system capable of suspending particles of 300 to 5000 microns in size.

Moreover, because of the unique way in which the systems are formed (e.g., formation of polymer gum solution from polymer and water in substantial absence of surfactant or electrolyte competition for water), the suspending network is highly resistant to ionic species, will not readily precipitate and will form transparent/translucent detergent compositions which are stable to ionic species while remaining readily pourable and stable.

Compositions

The various components of this invention for heavy duty liquid (HDL) detergent compositions are set forth in greater detail below.

Suspending Polymers and Polymer Mixtures

Compositions made by the process of this invention contain a polymer or polymer mixture which are capable of suspending relative large size particles while remaining readily pourable.

Specifically the polymer or mixture are selected to form a non-continuous suspending system. It is well known that polymers which require at least some ionic and/or surfactant species to be present as a prerequisite for network formation are susceptible to destabilization by surfactant, whether formed as a continuous network or as a non-continuous network of gum "bits". This invention surprisingly found that a polymer or polymer mix capable of forming a network (e.g., by the presence of electrolytes) can be stable in heavy duty liquid detergent compositions with high surfactant concentration (i.e., 15% to 85%, by wt., preferably 20% to 80%, more preferably 21% to 75% by wt. of the composition) if prepared in the proper way. This is the case even with ionic surfactants.

The polymer or polymer mixture which is capable of forming a non-continuous network of the subject invention will usually be of natural origin, specifically one or more polysaccharides will preferably be used. Generally, they will have MW of greater than half a million daltons. However, it is possible that the polymer, or one or more polymers in a mixture of polymers, might be a chemically modified natural polymer such as a polysaccharide which has been chemically treated to provide or alter substituent groups thereon. It is also conceivable that a polymer mixture might contain a synthetic polymer together with a natural polymer. Usually however, the polymer which is used will include a polysaccharide chain of natural origin.

Examples of gums which may be used are various commercial gums which may be characterized as (1) marine plant; (2) terrestial plants; (3) microbial polysaccharides and (4) polysaccharide derivatives. In addition, gums may include those derived from animal sources (e.g., from skin and/or bones of animals) such as gelatin.

Examples of nonionic plant gums include agar, alginates, carrageenan and furcellaran. Examples of terrestial plant gums include guar gum, gum arabic, gum tragacanth, karaya gum, locust bean gum and pectin. Examples of microbial polysaccharides include dextran, gellan gum, rhamsan gum, welan gum, xanthan gum. Examples of polysaccharide derivatives include carboxymethylcellulose, methyl hydroxypropyl cellulose, hydroxypropyl cellulose, hydroxyethyl cellulose, propylene glycol alginate, hydroxypropyl guar and modified starches.

One polysaccharide gum which may be used for example is carrageenan (from class of marine plant gums as noted above), especially kappa carrageenan. Kappa carrageenans are a class of polysaccharides which occur in some other red seaweed species. They are linear polysaccharides made up from alternating beta-1, 3- and alpha-1, 4-linked galactose residues. The 1,4-linked residues are the D-enantiomer and sometimes occur as the 3, 6-anhydride. Many of the galactose resides are sulfated.

A number of carrageenan structures have been described and commercial materials are available which approximate to the ideal structures. However, variations between these structures occur, depending on the source of the carrageenan and the treatment of it after extraction.

A description of different carrageenan types is given in "Carrageenans" by Norman F. Stanley which is Chapter 3 of "Food Gels". Kappa carrageenan is sulfated on the 1, 3-linked galactose residues, but not on the 1, 4-linked resides. Iota carrageenan is sulfated on both residues. Lambda carrageenan has two sulfate groups on the 1, 4-linked residues and one sulfate group on 70% of the 1, 3-linked residues.

Other types of carrageenan may be used in mixtures with kappa. Aqueous solutions of iota carrageenan exist as reversible gels, but these are self healing. Iota carrageenan can be used to form compositions in accordance with this invention, but the compositions become lumpy during storage because of the self-healing property of iota carrageenan gels. Therefore, for this invention it is desirable to use kappa carrageenan or mixtures of kappa and iota.

Lambda carrageenan on its own in aqueous solution does not form gels because its higher charge density inhibits association between molecules and consequent structuring in liquids. However, some lambda carrageenan may be included in mixtures with kappa, or may be present as an impurity in commercial supplies of kappa or iota carrageenan.

If lambda carrageenan is included in a mixture of carrageenans, the mixture may contain a majority (more than half of the polysaccharide) of kappa or kappa and iota carrageenan with a minority proportion of lambda carrageenan.

Another polymer that is similar to kappa carrageenan is Furcellaran. It is only partially sulfated on the 1, 3-linked galactose residues.

A polymer/gum of bacterial origin which also may be used is gellan. It is the polymer of a tetrasaccharide repeat unit, containing glucose, glucurronic acid, glucose and rhamrose residues. There is some substitution with acyl groups but these are often removed during production to give a low acyl gellan. Gellans are the subject of Chapter 6 by G. R. Saunderson in "Food Gels" mentioned above.

Another possibility is to use a so-called synergistic gel which relies on the interaction of two polymer types. In general these may be formed from a polysaccharide, which is a glucomannan with sequences of mannose residue in its polymer chain, such as locust bean gum or guar gum, and a second polymer which is xanthan or carrageenan.

Many of the polymers noted above, when in aqueous solution, form so-called reversible gels which melt when heated, but revert to gels when cooled. A well known example of polysaccharide forming reversible gel is agar. An aqueous solution containing a small percentage of agar is a mobile liquid when hot, but when left to cool it forms a gel with sufficient rigidity to maintain its own shape. Other naturally occurring polymers which can form reversible polymers are carrageenan, forcelleran, gellan and pectin.

The formation of gels by natural polysaccharides arises from interaction between the polymer molecules. Reversible gels generally display a melting temperature or temperature range, referred to as the gel point. This is the temperature at which, on slow heating, the gel is observed to melt as this interaction largely disappears. Thus, above the gel point, the hot solution of polymer is mobile. When it cools below its gel point, the interaction of polymer molecules enables them to form a continuous and branded network which extends throughout the sample. In contrast with the formation of a continuous, branched network, some other materials which thicken water do so through merely local, transient entanglement of molecules. A discussion of polysaccharide gels, including their range of mechanical properties, is found in "Gels and gelling" by Allan H. Clark which is Chapter 5 in Physical Chemistry of Foods, Schwartzberg and Hartel, editors; published by Marcel Dekker 1992.

The melting temperature of a gel can suitably be measured by placing a steel ball, having a diameter of approximately 1 mm, on the surface of a sample which is fully set, then raising the temperature slowly, e.g., in a programmable water bath. The gel melting point is the temperature at which the ball begins to sink through the sample. Apparatus to facilitate such determinations is available, for example a Physica AMV200 rolling viscometer from Anton Paar KG.

A reversible gel also displays a transition temperature at which, upon slow temperature increase, all ordering, be it of microscopical or macroscopical extent, has disappeared completely. This transition temperature can be measured by means of differential scanning calorimetry (DSC). The transition temperature of a reversible gel, as measured by DSC, usually approximately coincides with gel melting observable visually.

Suspending polymers particularly useful for this application include, but are not limited to: gellan gum (e.g. Kelcogel from Monsanto Corp.), rhamsan gum (e.g. K7C233 from Monsanto Corp.), carrageenan gum (e.g. Genugel X-0909 from Copenhagen Pectin Co.) agar, and furcellaran.

The gums noted above will form a "non-continuous" network suspending any particles desired for suspension. Because of the process of pre-swelling prior to contact with the main surfactants and/or electrolytes, the network is stable to ionic species and will not turn opaque.

In another embodiment of the invention, the polymer suspending system will comprise a polysaccharide or mixture polysaccharides as noted above in combination with cationic polymer. Suspending polymer mixtures particularly useful for this embodiment include, but are not limited to: gellan gum plus cationic guar (e.g. Jaguar C162 from Rhone-Poulenc Co.), gellan gum plus polyquaternium 10 (e.g. Ucare Polymer JR 30M from Amerchol Corp.), all at from 5:1 to 100:1 gum to cationic polymer. Suspending polymer/polymer mixtures are used in the formulation in an amount from about 0.01% to about 3% total polymer, preferably between 0.1% and 0.6% total polymer.

In addition to the gum networks, an additional thickening agent, such as a small concentration of other types of structuring agents, including gums, can be added. Examples of such accessory structurants include polysaccharide derivatives such as carboxymethyl cellulose, methylhydroxy propylcellulose, etc. The thickening, agent may be added at any point in the process.

The key to the invention resides not so much in the use of the polymer(s) themselves (although specific polymers which form networks are needed, but in their formation in such a way that they do not interact with ionic/surfactant species which normally destabilize them. If not pre-swollen (e.g., through time or heat) to form "suspension bits" either prior to adding to composition, or in situ, there will occur the types of destabilizing reactions well known in the art. It is for this reason that it is believed that the art has never been able to produce suspending systems which are translucent/transparent, a highly desirable objective of the subject invention.

Detergent Active

The compositions of the invention contain one or more surface active agents (surfactants) selected from the group consisting of anionic, nonionic, cationic, ampholytic and zwitterionic surfactants or mixtures thereof. The preferred surfactant detergents for use in the present invention are mixtures of anionic and nonionic surfactants although it is to be understood that any surfactant may be used alone or in combination with any other surfactant or surfactants. The surfactant must comprise at least 15% by wt. of the composition, e.g., 15% to 85%, preferably 20% to 80%, more preferably 21% to 75% of total composition.

Nonionic Surfactant

Nonionic synthetic organic detergents which can be used with the invention, alone or in combination with other surfactants, are described below.

As is well known, the nonionic detergents are characterized by the presence of an organic hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929.

Usually, the nonionic detergents are polyalkoxylated lipophiles wherein the desired hydrophile-lipophile balance is obtained from addition of a hydrophilic poly-lower alkoxy group to a lipophilic moiety. A preferred class of nonionic detergent is the alkoxylated alkanols wherein the alkanol is of 9 to 18 carbon atoms and wherein the number of moles of alkylene oxide (of 2 or 3 carbon atoms) is from 3 to 12. Of such materials it is preferred to employ those wherein the alkanol is a fatty alcohol of 9 to 11 or 12 to 15 carbon atoms and which contain from 5 to 8 or 5 to 9 alkoxy groups per mole.

Exemplary of such compounds are those wherein the alkanol is of 12 to 15 carbon atoms and which contain about 7 ethylene oxide groups per mole, e.g. Neodol 25-7 and Neodol 23-6.5, which products are made by Shell Chemical Company, Inc. The former is a condensation product of a mixture of higher fatty alcohols averaging about 12 to 15 carbon atoms, with about 7 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Other useful nonionics are represented by the commercially well-known class of nonionics sold under the trademark Plurafac. The Plurafacs are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide, or mixtures of any of the above.

Another group of liquid nonionics are commercially available from Shell Chemical Company, Inc. under the Dobanol trademark: Dobanol 91-5 is an ethoxylated $C_9$–$C_{11}$ fatty alcohol with an average of 5 moles ethylene oxide and Dobanol 23-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ primary fatty alcohols with relatively narrow contents of ethylerne oxide in the range of from about 7 to 9 moles, and the $C_9$ to $C_{11}$ fatty alcohols ethoxylated with about 5–6 moles ethylene oxide.

Another class of nonionic surfactants which can be used in accordance with this invention are glycoside surfactants. Glycoside surfactants suitable for use in accordance with the present invention include those of the formula:

$$RO—R'O—_y(Z)_x$$

wherein R is a monovalent organic radical containing from about 6 to about 30 (preferably from about 8 to about 18) carbon atoms; R' is a divalent hydrocarbon radical containing from about 2 to 4 carbons atoms; O is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1.5 to about 10).

A particularly preferred group of glycoside surfactants for use in the practice of this invention includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4 (preferably from about 1 to 4).

Nonionic surfactants particularly useful for this application include, but are not limited to: alcohol ethoxylates (e.g. Neodol 25-9 from Shell Chemical Co.), alkyl phenol ethoxylates (e.g. Tergitol NP-9 from Union Carbide Corp.), alkylpolyglucosides (e.g. Glucapon 600CS from Henkel Corp.) , polyoxyethylenated polyoxypropylene glycols (e.g. Pluronic L-65 from BASF Corp.), sorbitol esters (e.g. Emsorb 2515 from Henkel Corp.) , polyoxyethylenated sorbitol esters (e g. Emsorb 6900 from Henkel Corp.), alkanolamides (e.g. Alkamide DC212/SE from Rhone-Poulenc Co.), and N-alkypyrrolidones (e.g. Surfadone LP-100 from ISP Technologies Inc.).

Nonionic surfactant is preferably used in the formulation from about 0% to about 70%, more preferably between 5% and 50%.

Mixtures of two or more of the nonionic surfactants can be used.

Anionic Surfactant Detergents

Anionic surface active agents which may be used in the present invention are those surface active compounds which contain a long chain hydrocarbon hydrophobic group in their molecular structure and a hydrophilic group, i.e.; water solubilizing group such as sulfonate or sulfate group. The anionic surface active agents include the alkali metal (e.g. sodium and potassium) water soluble higher alkyl benzene sulfonates, alkyl sulfonates, alkyl sulfates and the alkyl polyether sulfates. They may also include fatty acid or fatty acid soaps. The preferred anionic surface active agents are the alkali metal, ammonium or alkanolamide salts of higher alkyl benzene sulfonates and alkali metal, ammonium or alkanolamide salts of higher alkyl sulfonates. Preferred higher alkyl sulfonates are those in which the alkyl groups contain 8 to 26 carbon atoms, preferably 12 to 22 carbon atoms and more preferably 14 to 18 carbon atoms. The alkyl group in the alkyl benzene sulfonate preferably contains 8 to 16 carbon atoms and more preferably 10 to 15 carbon atoms. A particularly preferred alkyl benzene sulfonate is the sodium or potassium dodecyl benzene sulfonate, e.g. sodium linear dodecyl benzene sulfonate. The primary and secondary alkyl sulfonates can be made by reacting long chain alpha-olefins with sulfites or bisulfites, e.g. sodium bisulfite. The alkyl sulfonates can also be made by reacting long chain normal paraffin hydrocarbons with sulfur dioxide and oxygen as described in U.S. Pat. Nos. 2,503,280, 2,507,088, 3,372,188 and 3,260,741 to obtain normal or secondary higher alkyl sulfonates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the C10 to C18 primary normal alkyl sodium and potassium sulfonates, with the C10 to C15 primary normal alkyl sulfonate salt being more preferred.

Mixtures of higher alkyl benzene sulfonates and higher alkyl sulfonates can be used as well as mixtures of higher alkyl benzene sulfonates and higher alkyl polyether sulfates.

The alkali metal alkyl benzene sulfonate can be used in an amount of 0 to 70%, preferably 5 to 50% and more preferably 10 to 20% by weight.

The alkali metal sulfonate can be used in admixture with the alkylbenzene sulfonate in an amount of 0 to 70%, preferably 10 to 50% by weight.

Also normal alkyl and branched chain alkyl sulfates (e.g., primary alkyl sulfates or secondary alcohol sulfates) may be used as the anionic component.

The higher alkyl polyether sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl poly ethoxy sulfates used in accordance with the present invention are represented by the formula:

$$R'—O(CH_2CH_2O)_p—SO_3M,$$

where R' is $C_8$ to $C_{20}$ alkyl, preferably $C_{10}$ to $C_{18}$ and more preferably $C_{12}$ to $C_{15}$; P is 2 to 8, preferably 2 to 6, and more preferably 2 to 4; and M is an alkali metal, such as sodium and potassium, or an ammonium cation. The sodium and potassium salts are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt: $C_{15}$ primary alkyl tetraethoxy sulfate, sodium salt, mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, alkyl sulfonates, or alkyl sulfates.

The alkali metal higher alkyl poly ethoxy sulfate can be used with the alkylbenzene sulfonate and/or with an alkyl sulfonate or sulfonate, in an amount of 0 to 70%, preferably 5 to 50% and more preferably 10 to 20% by weight of entire composition.

Anionic surfactants particularly useful for this application include, but are not limited to: linear alkyl benzene sulfonates (e.g. Vista C-500 from Vista Chemical Co.), alkyl sulfates (e.g. Polystep B-5 from Stepan Co.), polyoxyethylenated alkyl sulfates (e.g. Standapol ES-3 from Stepan Co.), alpha olefin sulfonates (e.g. Witconate AOS from witco Corp.), alpha sulfo methyl esters (e.g. Alpha-Step MC-48 from Stepan Co.) and isethionates (e.g. Jordapon Cl from PPG Industries Inc.).

Anionic surfactant is used in the formulation from about 0 to about 60%, preferably between 5% and 40%, more preferably 2% to 25%.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Amphoteric Surfactants

Ampholytic synthetic detergents can be broadly described as derivatives of aliphatic or aliphatic derivatives of heterocyclic secondary and tertiary amines in which the aliphatic radical may be a straight chain or a branched and wherein one of the aliphatic substituents contains from about 8 to 18 carbon atoms and at least one contains an anionic water-solubilizing group, e.g. carboxy, sulfonate, sulfate. Examples of compounds falling within this definition are sodium 3(dodecylamino)propionate, sodium 3-(dodecylamino)propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Sodium 3-(dodecylamino)propane-l-sulfonate is-preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The amount of amphoteric active used may vary from 0 to 50% by weight, preferably 1 to 30% by weight.

It should be noted that the compositions of the invention are preferably isotropic and either transparent or translucent.

Total surfactant used will be at least 15%, preferably 20%, more preferably 21% by wt., even more preferably 25% by wt.

Builders/Electrolyte

Builders which can be used according to this invention include conventional alkaline detergency builders, inorganic or organic, which can be used at levels from about 0% to about 50% by weight of the composition, preferably from 1% to about 35% by weight.

As used herein, the term electrolyte means any water-soluble salt.

Preferably the composition comprises at least 1.0% by weight, more preferably at least 5.0% by weight, most preferably at least 10.0% by weight of electrolyte. The electrolyte may also be a detergency builder, such as the inorganic builder sodium tripolyphosphate, or it may be a non-functional electrolyte such as sodium sulfate or chloride. Preferably the inorganic builder comprises all or part of the electrolyte.

Although no electrolyte is required, preferably at least 1% electrolyte is used, more preferably 3% to as much as about 50% by weight electrolyte.

The compositions of the invention are capable of suspending particulate solids, although particularly preferred are those systems where such solids are actually in suspension. The solids may be undissolved electrolyte, the same as or different from the electrolyte in solution, the latter being saturated in electrolyte. Additionally, or alternatively, they may be materials which are substantially insoluble in water alone. Examples of such substantially insoluble materials are aluminosilicate builders and particles of calcite abrasive.

Examples of suitable inorganic alkaline detergency builders which may be used are water-soluble alkali metal phosphates, polyphosphates, borates, silicates and also carbonates. Specific examples of such salts are sodium and potassium triphosphates, pyrophosphates, orthophosphates, hexametaphosphates, tetraborates, silicates, and carbonates.

Examples of suitable organic alkaline detergency builder salts are: (1) water-soluble amino polycarboxylates, e.g., sodium and potassium ethylenediaminetetraacetates, nitrilotriacetates and N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-l,1-diphosphonic acid; sodium, potassium and lithium salts of methylene diphosphonic acid; sodium, potassium and lithium salts of ethylene diphosphonic acid; and sodium, potassium and lithium salts of ethane-l,l, 2-triphosphonic acid. Other examples include the alkali metal salts of ethane-2-carboxy-l,l-diphosphonic acid hydroxymethanediphosphonic acid, carboxyldiphosphonic acid, ethane-1-hydroxy-l,l,2-triphosphonic acid, ethane-2-hydroxy-l,l,2-triphosphonic acid, propane-1,1,3,3-tetraphosphonic acid, propane-1,1,2,3-tetraphosphonic acid, and propane-1,2,2,3-tetra-phosphonic acid; (4) water-soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid, salts of polymers of itaconic acid and maleic acid, tartrate monosuccinate, tartrate disuccinate and mixtures thereof (TMS/TPS).

Certain zeolites or aluminosilicates can be used. One such aluminosilicate which is useful in the compositions of the invention is an amorphous water-insoluble hydrated compound of the formula $Na_x[(AlO_2)_y.SiO_2)$, wherein x is a number from 1.0 to 1.2 and y is 1, said amorphous material being further characterized by a Mg++ exchange capacity of from about 50 mg eq. $CaCO_3$/g. and a particle diameter of from about 0.01 mm to about 5 mm. This ion exchange builder is more fully described in British Patent No. 1,470,250.

A second water-insoluble synthetic aluminosilicate ion exchange material useful herein is crystalline in nature and has the formula $Na_z[(AlO_2)_y(SiO_2)]_xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 mm to about 100 mm; a calcium ion exchange capacity on an anhydrous basis of at test about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

Enzymes

Enzymes which may be used in the subject invention are described in greater detail below.

If a lipase is used, the lipolytic enzyme may be either a fungal lipase producible by Humicola lanuginosa and Thermomyces lanuginosus, or a bacterial lipase which show a positive immunological cross-reaction with the antibody of the lipase produced by the microorganism Chromobacter T viscosum var. lipolyticum NRRL B-3673. This microorganism has been described in Dutch patent specification 154, 269 of Toyo Jozo Kabushiki Kaisha and has been deposited with the Fermentation Research Institute, Agency of Industrial Science and Technology, Ministry of International Trade and Industry, Tokyo, Japan, and added to the permanent collection under nr. KO Hatsu Ken Kin Ki 137 and is available to the public at the United States Department of Agriculture, Agricultural Research Service, Northern Utilization and Development Division at Peoria, Ill., USA, under the nr. NRRL B-3673. The lipase produced by this microorganism is commercially available from Toyo Jozo Co., Tagata, Japan, hereafter referred to as "TJ lipase". These bacterial lipases should show a positive immunological cross-reaction with the TJ lipase antibody, using the standard and well-known immune diffusion procedure according to Ouchterlony (Acta. Med. Scan., 133. pages 76–79 (1930).

The preparation of the antiserum is carried out as follows:

Equal volumes of 0.1 mg/ml antigen and of Freund's adjuvant (complete or incomplete) are mixed until an emulsion is obtained. Two female rabbits are injected 45 with 2 ml samples of the emulsion according to the following scheme:

day 0: antigen in complete Freund's adjuvant day 4: antigen in complete Freund's adjuvant day 32: antigen in incomplete Freund's adjuvant day 64: booster of antigen in incomplete Freund's adjuvant The serum containing the required antibody is prepared by centrifugation of clotted blood, taken on day 67.

The titre of the anti-TJ-lipase antiserum is determined by the inspection of precipitation of serial dilutions of antigen and antiserum according to the Ouchteriony procedure. A dilution of antiserum was the dilution that still gave a visible precipitation with an antigen concentration of 0.1 mg/ml.

All bacterial lipases showing a positive immunological cross reaction with the TJ-lipase antibody as hereabove described are lipases suitable in this embodiment of the invention. Typical examples thereof are the lipase 63 ex Pseudomonas fluorescens IAM 1057 (available from Amano Pharmaceutical Co., Nagoya, Japan, under the trade-name Amano-P lipase), the lipase ex Pseudomonas fragi FERM P 1339 (available under the trade-name Amano B), the lipase ex Pseudomonas nitroreducens var. lipolyticum FERM P1338, the lipase ex Pseudomonas sp. (available under the trade-name Amano CES), the lipase ex Pseudomonas cepacia, lipases ex Chromobacter viscosum, e.g. Chromobacter viscosum var. lipolyticum NRRL B-3673, commercially available from Toyo Jozo Co., Tagata, Japan; and further Chromobacter viscosum lipases from U.S. Biochemical Corp. USA and Diosynth Co., The Netherlands, and lipases ex Pseudomonas gladioli.

An example of a fungal lipase as defined above is the lipase ex Humicola lanuginosa available from Amano under the tradename Amano CE; the lipase ex Humicola lanuginosa as described in the aforesaid European Patent Application 0,258,068 (NOVO), as well as the lipase obtained by cloning the gene from Humicola lanuginosa and expressing this gene in Aspergillus oryzae, commercially available from NOVO industri A/S under the tradename "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/ml when the formulation is dosed at a level of about 0.1–10, more preferably 0.5–7, most preferably 1–2 g/liter.

A Lipase Unit (LU) is that amount of lipase which produces 1/mmol of titratable fatty acid per minute in a pH state under the following conditions: temperature 30° C.; pH=9.0; substrate is an emulsion of 3.3 wt. % of olive oil and 3.3% gum arabic, in the presence of 13 mmol/l $Ca^{2+}$ and 20 mmol/l NaCl in 5 mmol/l Trisbuffer.

Naturally, mixtures of the above lipases can be used. The lipases can be used in their non-purified form or in a purified form, e.g. purified with the aid of well-known absorption methods, such as phenyl sepharose absorption techniques.

If a protease is used, the proteolytic enzyme can be of vegetable, animal or microorganism origin. Preferably, it is of the latter origin, which includes yeasts, fungi, molds and bacteria. Particularly preferred are bacterial subtilisin type proteases, obtained from e.g. particular strains of *B. subtilis* and *B licheniformis*. Examples of suitable commercially available proteases are Alcalase, Savinase, Esperase, all of NOVO Industri A/S; Maxatase and Maxacal of Gist-Brocades; Kazusase of Showa Denko; BPN and BPN' proteases and so on. The amount of proteolytic enzyme, included in the composition, ranges from 0.05–50,000 GU/mg. preferably 0.1 to 50 GU/mg, based on the final composition. Naturally, mixtures of different proteolytic enzymes may be used.

While various specific enzymes have been described above, it is to be understood that any protease which can confer the desired proteolytic activity to the composition may be used and this embodiment of the invention is not limited in any way be specific choice of proteolytic enzyme.

In addition to lipases or proteases, it is to be understood that other enzymes such as cellulases, oxidases, amylases, peroxidases and the like which are well known in the art may also be used with the composition of the invention. The enzymes may be used together with cofactors required to promote enzyme activity, i.e., they may be used in enzyme systems, if required. It should also be understood that enzymes having mutations at various positions (e.g., enzymes engineered for performance and/or stability enhancement) are also contemplated by the invention. One example of an engineered commercially available enzyme is Durazym from Novo.

Optional Ingredients

In addition to the enzymes mentioned above, a number of other optional ingredients may be used.

Alkalinity buffers which may be added to the compositions of the invention include monoethanolamine, triethanolamine, borax, sodium silicate and the like.

Hydrotropes which may be added to the invention include ethanol, sodium xylene sulfonate, sodium cumene sulfonate and the like.

Other materials such as clays, particularly of the water-insoluble types, may be useful adjuncts in compositions of this invention. Particularly useful is bentonite. This material is primarily montmorillonite which is a hydrated aluminum silicate in which about ⅙th of the aluminum atoms may be replaced by magnesium atoms and with which varying amounts of hydrogen, sodium, potassium, calcium, etc. may be loosely combined. The bentonite in its more purified form (i.e. free from any grit, sand, etc.) suitable for detergents contains at least 30% montmorillonite and thus its cation exchange capacity is at least about 50 to 75 meg per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Patent No. 401,413 to Marriott and British Patent No. 461,221 to Marriott and Guam.

In addition, various other detergent additives of adjuvants may be present in the detergent product to give it additional desired properties, either of functional or aesthetic nature.

Improvements in the physical stability and anti-settling properties of the composition may be achieved by the addition of a small effective amount of an aluminum salt of a higher fatty acid, e.g., aluminum stearate, to the composition. The aluminum stearate stabilizing agent can be added in an amount of 0 to 3%, preferably 0.1 to 2.0% and more preferably 0.5 to 1.5%.

There also may be included in the formulation, minor amounts of soil suspending or anti-redeposition agents, e.g. polyvinyl alcohol, fatty amides, sodium carboxymethyl cellulose, hydroxy-propyl methyl cellulose, A preferred anti-redeposition agent is sodium carboxylmethyl cellulose having a 2:1 ratio of CM/MC which is sold under the tradename Relatin DM 4050.

Another minor ingredient is soil releasing agents, e.g. deflocculating polymers. In general, a deflocculating polymer comprises a hydrophilic backbone and one or more hydrophobic side chains.

The deflocculating polymer of the invention is described in greater detail in U.S. Pat. No. 5,147,576 to Montague et al. hereby incorporated by reference into the subject application.

The deflocculating polymer generally will comprise, when used, from about 0.1 to about 5% of the composition, preferably 0.1 to about 2% and most preferably, about 0.5 to about 1.5%.

Optical brighteners for cotton, polyamide and polyester fabrics can be used. Suitable optical brighteners include Tinopal LMS-X, stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-foam agents, e.g. silicone compounds, such as Silicane L 7604, can also be added in small effective amounts.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/372 and ultramarine blue can be used.

Also, soil release polymers and cationic softening agents may be used.

The list of optional ingredients above is not intended to be exhaustive and other optional ingredients which may not be listed, but are well known in the art, may also be included in the composition.

Optionally, the inventive compositions may contain all or some the following ingredients: zwitterionic surfactants (e.g. Mirataine BET C-30 from Rhone-Poulenc Co.), cationic surfactants (e.g. Schercamox DML from Scher Chemicals, Inc.), fluorescent dye, antiredeposition polymers, antidye transfer polymers, soil release polymers, protease enzymes, lipase enzymes, amylase enzymes, cellulase enzymes, peroxidase enzymes, enzyme stabilizers, perfume, opacifiers, UV absorbers, builders, and suspended particles of size range 300–5000 microns.

Structure Formation

In most polymer-structured systems, polymers form a continuous network through the system. Polymers in these types of systems are prone to dehydration or a salting out effect. These polymers include families of Xanthan gum polyacrylates, etc. Surprisingly, applicants have discovered that one can construct a system with non-continuous gum bits to form a highly shear-thinning rheological property and maintain a high degree of transparency. The size of the transparent particles can be in the range of less than 5000, preferably less than 3000, more preferably, less than 2000 microns to sub-micron. The reflect index of the gum network is similar to the bulk liquid detergent. The discrete gum particles form a non-continuous network structuring by contacting the surrounding particles. The Columbic friction force at the contacting points forms a structure that can suspend other visible particles. Furthermore the structure formed by the Columbic friction force can be easily destroyed by a shear force, such as pouring the liquid detergent, and exhibits a low viscosity behavior. In general the distribution of particles or bits in liquid is depended on the net buoyant force (the sum of gravitational and buoyant forces) and Columbic force. The net buoyant force supports parts of the weight of bits. The rest part of the weight of bits is supported by the underlying layer of solid particles or the bottom and wall of vessel. This support force is referred to as the Coulombic force. The friction force between particles is proportional to this Coulombic force. This friction force also provides the structuring of system. The gum particles are prepared-either by pre-forming gum particles and contacting with the base or by forming gum particles in-situ with the rest of the liquid detergent base.

More specifically, the process of the invention comprises first forming a polymer gum solution by mixing 0.01 to 5% by wt. (of gum solutions) of specific polymer gums which will form a non-continuous, network when the polymer solution forms gum particles in the final solution.

Specific polymers which will form such non-continuous network include carrageenan, gellan, and agar as discussed above.

Once the polymer gel solution is formed, the "bits" which will form the non-continuous structure may actually be formed with in least one of the following two ways.

The "bits" may be performed in the polymer gel solution by some mechanism which will promote formation of the now pre-swollen (e.g., with water) gum polymers.

This mechanism comprises simple agitation of the polymer gum solution in combination with either temperature differentials or addition of counterion to the polymer gum solution.

For example, if agar or gelatin is used as the principle gum, agitation plus thermal precipitation is generally sufficient to cause formation of "bits" in the polymer gel solution. One point to be noted about using such thermal precipitation is that, when the composition with suspending non-continuous network is formed upon heating and suspended particles (e.g., capsules) are added (after cooling), when the composition is subsequently reheated there may be migration of particles which will be observed when the composition is re-cooled.

On the other hand, if gellan is used as the primary gum, it can be used like agar or gelatin (i.e., no counterion needed); however, it is generally preferred the counterion be used to cause formation of bits. Examples of counterion which may be used include materials such as calcium, sodium, potassium which may be introduced as salts of compounds. Examples of such salts include, but are not limited to sodium citrate, potassium citrate, sodium LAS, sodium LES, calcium chloride.

About 0.01 to 20% salt is generally required to obtain this counterion effect.

Another example of counterion effect is with carrageenan. For example, when 0.01 to 20% of potassium salt is added to polymer gum solution made from carrageenan, "bits" will readily form.

An example of thermal precipitation of "bits" is agar as noted above. Gellan and carrageenan may also be formed by such thermal precipitation.

It should be understood that although "bits" may be formed directly from polymer gum solution and that the polymer gum with bits may then be added to a detergent base (order of addition is not important) to form final detergent, it is also possible to slowly add surfactant and other detergent base components to the polymer gum solutions so that formation of the "bits" is accomplished as additional ingredients are added.

This so-called "addition" method (in-situ formation) generally comprises forming polymer gum, adding counterion and agitating to form "bits" and slowly adding surfactants and other components. However, it should be understood that addition of counterion is not required by this method and that, for example, agitation and slow "build-up" may be sufficient. This is a preferred method, for example, then agar is used as principal gum forming polymer gum solution.

Flow Properties

The pouring viscosity of the present aqueous liquid detergent composition can be in the range of 50 to 3000 centipoises, preferably 100 to 2000 centipoises, more preferably 150 to 1500. The pouring viscosity is measured at a shear rate of 21 1/sec measured at temperature of about 25° C. In the subject invention, viscosity was measured using a Haake RV20 Rotovisco meter, RC20 Rheocontroller and Haake F3-C circulators. Either MV1, MV2 or MV3 sensor system (e.g., cylindrical spindle) was used for the measurement. At the viscosities mentioned, the liquid detergent is easily pourable. The present aqueous liquid detergent composition is a stable dispersion/emulsion and can suspend 300 to 5000 micron particles.

Physical Properties

The compositions pertaining to this invention exhibits several special characteristics in Rheological properties, transmittance and storage stability.

Rheological Properties

Consumers tend to prefer a thick liquid detergent product, but also require that products pour easily. These two contradictory requirements only can be achieved by creating a formulation that has a highly shear thinning behavior. This means that at pouring stage (scientifically defined at about the shear rate of 21 1/sec), the viscosity value of liquid detergent formulations should be less than 3,000 cp and preferably less than 1,500 cp. At the viscosities mentioned, the liquid detergent is easily pourable.

The present aqueous liquid detergent composition can support 300 to 5,000 micron particles for at least 2 weeks, preferably at least 3 weeks, more preferably at least 5 weeks, at room temperature.

The compositions of the invention have at least 50% transmittance of light using 1 centimeter cuvette at a wavelength of 410–800 nm, preferably 570–690 nanometers, wherein the composition is measured in absence of dyes.

Alternatively, transparency of the composition may be measured as having an absorbency in the visible light wavelength (about 410 to 800 nm) of less than 0.3 which is in turn equivalent to at least 50% transmittance using cuvette and wavelength noted above. For purposes of the invention, as long as one wavelength in the visible light range has greater than 50% transmittance, it is considered to be transparent/translucent.

One of the properties of the compositions of the invention is that it contains gums which have been pre-swollen (with water) because, it is believed, the gum is able to absorb water when not in the presence of surfactant and/or electrolyte and thus does not have to compete with the surfactant and/or electrolyte for available water.

There are a variety of ways that can be used for testing how swollen a gum (or other material) has gotten. These include the use of dyes or other indicators (e.g., toluidine blue 0; methylene blue one iodine). By applying the indicator, the degree of swelling (due to water) of a given gum polymer may be readily observed.

Suspended Particles

Technically, it is well known in the art that heavy duty liquid detergents provide a hostile environment for desirable ingredients such as, for example, bleaches, enzymes and perfumes. Components which are sensitive to the ingredients found in the compositions (e.g., enzymes in detergent compositions, particularly concentrated detergent compositions, are denatured by surfactants in the detergent composition) can be encapsulated and protected until they are ready for release. Some types of encapsulated enzyme capsules are disclosed in U.S. Pat. No. 5,281,355 to Tsaur et al. and U.S. Pat. No. 5,589,370 to Ratuiste et al. Commercial enzyme granules originally designed for powder detergent, such as Purafect 3100G, can also be used in this application.

Components which are simply more desirably released later in the wash (e.g., perfumes, fabric softening agents or anti-foams) can be encapsulated and controllably released, for example, by dilution of a concentrated liquid.

Other components, such as anti-redeposition agent CP-5 polymer or builder zeolite are insoluble in isotropic heavy duty liquid detergent compositions. These fine, insoluble particles cause the opaqueness of products. To prevent the opaqueness, these fine particle components can be pre-granulated and post dosed as suspended particles.

Liquid components that are immiscible with liquid detergent compositions, such as amino silicone and silicone defoamer can be incorporated as encapsulates. Functional polymers including color protecting polymers, fabric protection polymers and soil release polymers, such as PVP (polyvinylpyrrolidone), Narlex DC-1 ex National Starch (e.g., polyacrylate type copolymer) that can be salted out due to the high electrolyte concentration in liquid detergent compositions also can be incorporated in an encapsulated form.

In particular, it is desirable to encapsulate one or more enzymes since enzymes are highly efficient laundry washing ingredients used to promote removal of soils and stains during the cleaning process. Furthermore, it is also desirable to encapsulate bleach and enzymes separately to further enhance detergent efficacies.

Aesthetically, inclusion of suspended particles in the liquid produces a product form not previously seen in the HDL category by consumers which may be appealing. Thus, particles that do not contain any detergent ingredients may be also used in this application.

The size of the suspended particles used in this application is in the range of 300 to 5000 microns, preferably 500 to 2500 microns, and most preferably 700 to 2000. The density should be in the range of 0.8 to 3 g/cm$^3$, preferably in the range of 0.9 to 1.8 g/cm$^3$, and most preferably in the range of 0.95 to 1.20 g/cm$^3$.

EXAMPLES

The following examples are intended to further illustrate and describe the invention and are not intended to limit the invention in any way. Unless noted otherwise, all percentages are intended to be by weight.

Examples A–D

Preparation of Suspended Capsules

Several types of capsules were prepared in the lab to use for suspending and storage studies. The composition variations are shown in Table 1.

TABLE 1

| Raws | Example A, g | Example B, g | Example C, g | Example D, g |
|---|---|---|---|---|
| Deionized water | 2820.00 | 98.00 | 32.20 | 29.40 |
| K-carrageenan gum | 60.00 | 2.00 | 0.80 | 0.60 |
| Zeolite | 90.00 | 0.00 | 4.00 | 2.00 |
| white pigment | 30.00 | 0.00 | 0.00 | 0.00 |
| 30% PVP solution | 0.00 | 40.00 | 40.00 | 20.00 |
| Fluorescent dye | 0.00 | 1.00 | 0.00 | 0.00 |

PVP=polyvinylpyrrolidone

Specifically, Kappa-carrageenan gum powder and water were mixed and heated to 160° F. until the gum was well dispersed and hydrated. Other ingredients were added according to the list of Table 1 and mixing was continued until the ingredients were well mixed. The composition was cooled to room temperature for spraying through a two-fluid nozzle into a 5% KCI hardening solution bath. Capsules were collected and passed through screens of 500 and 2000 microns.

Example E

Preparation of Suspended Capsules

Capsules using gellan gum were also prepared by: a) mixing 1000 g of deionized water, 5 g of Kelcogel LT (gellan gum Ex Monsanto) and 1.5 g of sodium citrate; b) mixing and heating to 180° F. for 30 minutes; c) turning off heat and mixing in 10 g pigment; d) letting cool to room temperature; and e) spraying through two-fluid nozzle into 10% NaCl hardening solution.

Example E typifies the compositions of these type of capsule particles.

| Particles | | | | |
|---|---|---|---|---|
| Raws | Kelcogel LT | Water | sodium citrate | Pigment |
| G | 5 | 1000 | 1.5 | 10 |
| Hardening solution | | | | |
| Raws | NaCl | Water | | |
| G | 200 | 1800 | | |

Other functional ingredients were added to the gellan capsules similar to ingredients added to kappa-carrageenan capsules of Examples A–D. Other examples of ingredients which can be added to the capsules include PVP, fluorescent dye and silicone oil.

Examples 1 to 6

Six liquid detergent compositions are given in Table 1 below:

TABLE 1

| Ingredients | Example 1, % | Example 2, % | Example 3, % | Example 4, % | Example 5, % | Example 6, % |
|---|---|---|---|---|---|---|
| gellan/sodium citrate solution* | 6.8 | 6.8 | 6.8 | 6.8 | 6.8 | 22.7 |
| alcohol ethoxylate | 20.0 | 17.5 | 15.0 | 12.5 | 20.0 | 20.0 |
| alcohol ethoxylsulfate | 7.5 | 10.0 | 12.5 | 15.0 | 0. | 0. |
| Sodium linear alkylbenzene sulfonate | 0. | 0. | 0. | 0. | 7.75 | 0. |
| Triethanol amine | 4.0 | 4.0 | 4.0 | 4.0 | 4.0 | 4.08 |
| PVP (polyvinyl pyrollidone) | 0.6 | 0.6 | 0.6 | 0.6 | 0.6 | 0.6 |
| Soil release polymer | 0.35 | 0.35 | 0.35 | 0.35 | 0.35 | 0.35 |
| Fluorescer dye | 0.2 | 0.2 | 0.2 | 0.2 | 0.2 | 0.20 |
| Preservative | 0.0003 | 0.0003 | 0.0003 | 0.0003 | 0.0003 | 0.0003 |
| Water | To 100 | To 100 | to 100 | to 100 | to 100 | to 100 |

*0.75% gellan solution with 0.25% sodium citrate and balance water

The general procedure for preparing the liquid detergent compositions 1–6 of Table 1 was as follows: A 1000 gellan and sodium citrate premix solution was prepared by blending 7.5 g of the Kelcogel gum (Gellan) with 2.5 g of sodium citrate and balance deionized water. Once the mixture was well blended, it was brought up to 180° F. and mixed at that temperature for 1 hour. The syrup (premix) was then allowed to cool to room temperature. Batches were made on the benchtop using Tekmar stirrers. At this stage, the gellan gum syrup was a mixture of concentrated gellan gum particles. The addition of the raw materials for making liquid detergent base was done separately following the order of water, triethanol amine, PVP, Alcosperse 725 (soil release polymer), Fluorescer dye, and LAS acid. This was followed by adjusted pH to 9.0 with 50 w/w % NaOH solution, followed by the addition of alcohol ethoxysulfate, alcohol ethoxylate and preservative. The gellan gum syrup premix was then added and mixed in with the liquid detergent base.

One weight percent of capsules prepared by Example A (based on HDC weight) was added and dispersed. The capsules were suspended for more than 2 weeks at room temperature. Final product is transparent liquid detergent with visible capsules of Example A suspended in it. The composition was also readily pourable. Viscosity of the compositions was between 1000 and 1100 centipoise (cp) at $21S^{-1}$ apparent shear rate.

This example clearly shows that, if not prepared in a particular way, the transparent, suspending compositions of the invention are not formed.

Examples 7 to 9

The following examples are following the different process routes from Examples 1 to 6 in preparing the compositions shown in Table 2.

TABLE 2

| Raws | Example 7, lb. | Example 8, lb. | Example 9, lb. |
|---|---|---|---|
| deionized water | 6.18 | 6.18 | 6.18 |
| sodium citrate | 2.50 | 2.50 | 2.50 |
| 50% NaOH solution | 2.10 | 2.10 | 2.10 |
| propylene glycol | 3.38 | 3.38 | 3.38 |
| Premix I | | | |
| deionized water | 8.00 | 8.00 | 8.00 |
| sorbitol solution | 6.44 | 6.44 | 6.44 |
| Borax | 3.06 | 3.06 | 3.06 |
| LAS acid | 10.30 | 10.30 | 10.30 |
| Neodol 25-9* | 12.00 | 12.00 | 12.00 |
| sodium ethoxy sulfate | 39.26 | 39.26 | 39.26 |
| Premix II | | | |
| PR dye | 0.15 | 0.15 | 0.15 |
| Water | 4.00 | 4.00 | 4.00 |
| 50% NaOH | 0.05 | 0.05 | 0.05 |
| Kathon | 0.02 | 0.02 | 0.02 |
| Savinase | 0.46 | 0.46 | 0.46 |
| Lipolase | 0.83 | 0.83 | 0.83 |
| Perfume | 0.30 | 0.30 | 0.30 |
| Deionized water | 0.97 | 0.97 | 0.97 |
| Gum solution | | | |
| Gellan gum | 0.25 | 0.15 | 0.15 |
| Deionized water | 49.75 | 49.75 | 49.85 |
| Preservative | 0.01 | 0.01 | 0.00 |
| Capsule from Example E | 1% $d_{50}$ = 1000 microns | 2% $d_{50}$ = 2000 microns | 2.5% $d_{50}$ = 2500 microns |
| Storage stability, week | >2 | >2 | >2 |

*$C_{12}$–$C_{15}$ alkyl chain ethoxylate with 9 EO groups.

The general procedure for preparing the liquid detergent compositions 7–9 of Table 2 is as follows: A gellan solution was prepared by blending the Kelcogel gum(gellan) with deionized water. Once the mixture was well blended, it was brought up to 180° F. and mixed at that temperature for 1 hour to ensure hygiene protection. The gellan solution was then allowed to cool to room temperature. Preservative was added after the gellan solution was cooled to room temperature. Batches were made in the pilot plant using Lightening mixers. At this stage, the gellan gum mixture was a transparent isotropic liquid. The addition of the raw materials for making liquid detergent base was following the order of raw materials listed in Table 2.

There were two ways to incorporate the gellan gum solution into the liquid detergent base. First was to gradually add gellan gum solution into the liquid detergent base while the system was still agitating. The gellan gum particles were formed with the-interaction of gellan gum molecules and surfactanticitrate. Another method was gradually adding the liquid detergent base to the mixing gellan gum solution. The gel was formed by the interaction of gellan gum molecules and surfactant/citrate. The continuous mixing maintains the size of gellan gum bits to be small and to exhibit a smoother appearance. After the network was formed, the rate of addition of liquid detergent base was sped up.

Various sizes and amounts of capsules prepared by Example E (based on the HDL weight) were added to Examples 7 to 9 and dispersed. As shown in the Table 1, Examples 7 to 9 are all capable of suspending particles having an average size of 1000 to 2500 microns for more than 2 weeks under room temperature condition.

The viscosity of these compositions was between 700 and 750 cps at $21S^{-1}$ apparent shear rate.

Examples 10 to 11

The compositions of Examples 10 and 11 in Table 3 are prepared following the procedure described in Examples 7 to 9.

TABLE 3

| Heavy Duty Liquid | Example 10, g | Example 11, g |
|---|---|---|
| sodium citrate | 31.61 | 0.00 |
| deionized water | 299.26 | 251.84 |
| 50% NaOH | 50.58 | 50.58 |
| LAS acid | 222.34 | 222.34 |
| Neodol 25-9 | 98.00 | 98.00 |

TABLE 3-continued

| Heavy Duty Liquid | Example 10, g | Example 11, g |
|---|---|---|
| Premix I | | |
| deionized water | 21.07 | 21.07 |
| Flurorescent dye | 2.11 | 2.11 |
| 50% NaOH | 1.05 | 1.05 |
| Monoethanol amine | 15.81 | 15.81 |
| Gum solution | | |
| Gellan gum | 1.01 | 1.01 |
| Deionized water | 336.19 | 336.19 |
| Premix II | | |
| Deionized water | 0.00 | 47.42 |
| Sodium citrate | 0.00 | 31.61 |

The structure of composition was formed like Example 7. The manner of addition of Example 11 (i.e., citrate added at the structure is formed) implies that structure was formed with surfactant.

Capsules with average size of 1500 microns which were prepared according to Example E were used for storage study. About 1.5% of capsules were added and dispersed in the samples of Examples 10 & 11. The room temperature storage results show that the capsules were still suspended after two weeks storage. This again shows formation of transparent/translucent liquids able to form stable, suspending compositions which are pourable. Viscosity of these compositions was about 710 cp at $21S^{-1}$.

Examples 12 to 13

Examples 12 to 13 in Table 4 demonstrate the unexpected results of structuring high pH liquid detergent compositions with gellan gum and maintaining the transparency and pourability The order of addition is following the list of ingredients in the Table 4.

TABLE 4

| Ingredients | Example 12, g |
|---|---|
| deionized water | 209.94 |
| 50% NaOH | 45.26 |
| LAS acid | 152.49 |
| Neodol 25-9 | 46.02 |
| Premix 1 | |
| deionized water | 9.82 |
| Fluorescent dye | 1.34 |
| Stearic acid | 0.69 |
| 40% sodium xylene sulfonate | 32.22 |
| alcohol ethoxylate | |
| Premix II; check pH~12 | |
| Sodium silicate | 44.46 |
| Water | 1.84 |
| Gum solution | |
| Gellan gum | 1.25 |
| Deionized water | 248.75 |
| Capsules from Example | 1.5% |

TABLE 4-continued

| | |
|---|---|
| E $d_{50}$ = 1500 microns | |
| Storage stability, week | >2 |

| Ingredients | Example 13, g |
|---|---|
| sodium citrate | 12.50 |
| Water | 72.86 |
| 50% NaOH solution | 11.21 |
| 40% Sodium xylene sulfonate | 10.00 |
| LAS acid | 44.50 |
| Neodol 25-9 | 18.45 |
| Premix-I | |
| Water | 5.00 |
| Fluorescent dye | 0.50 |
| 50% NaOH | 0.25 |
| gum solution | |
| gellan gum | 0.38 |
| Water | 74.61 |
| Premix,; Check pH~12 | |
| Sodium silicate | 3.60 |
| Water | 0.15 |
| Monoethanolamine | 3.75 |
| Capsules from Example | 1.0 |
| E, $d_{50}$ = 3500 microns | |
| Storage stability, week | >2 |

About 1.5% of capsule from Example E with average size of 1500 microns were added and dispersed in the samples of Example 12. One percent of average 3500 mm particles prepared by Example E was added and dispersed in the sample of Example 13. The room temperature storage results show that the particles are still suspended after two weeks storage.

Examples 14 to 16

Examples 14 to 16 use kappa-carrageenan gum as a structurant. Example 14 uses the in-situ method to prepare gum bits and Examples 15 and 16 use sodium citrate to pre-form gum mixture. The order of preparation follows the list in Table 5.

TABLE 5

| Ingredients | Example 14, g | Example 15, g | Example 16, g |
|---|---|---|---|
| deionized water | 16.00 | 16.00 | 16.00 |
| 40% Na-xylene sulfonate | 12.80 | 0.00 | 0.00 |
| propylene glycol | 4.32 | 4.32 | 4.32 |
| 50% NaOH solution | 0.00 | 0.00 | 2.20 |
| monoethanol amine | 6.00 | 0.46 | 0.00 |
| coconut fatty acid | 1.60 | 1.60 | 1.60 |
| Triethanol amine | 40.00 | 4.18 | 0.00 |
| LAS acid | 39.30 | 9.28 | 9.28 |
| Neodol 25-9 | 15.00 | 8.70 | 8.70 |
| sodium borate, pentahydrated | 5.86 | 5.86 | 5.86 |
| sodium citrate, dihydrated | 3.00 | 3.00 | 3.00 |
| alcohol ethoxysulfate | 0.00 | 55.06 | 55.06 |
| Preservative | 0.00 | 0.04 | 0.04 |
| gum solution | | | |
| Kappa Carrageenan | 0.08 | 0.08 | 0.08 |
| Sodium citrate, dihydrated | 0.00 | 3.00 | 3.00 |
| Water | 39.92 | 39.92 | 39.92 |
| Water | 46.12 | 48.50 | 50.94 |
| Capsules from Example A $d_{50}$ = 1000 microns | 1% | 1% | 1% |
| Storage stability, week | >2 | >2 | 2 |

One weight percent of capsules prepared by Example A (based on the HDL weight) were added and dispersed. Storage study were carried out at room temperature to determine the suspending capacity of HDL base. As shown in the Tables, Examples 14 to 16 were all capable of suspending 1000 micron particles for more than 2 weeks.

Comparative 600 micron sized capsules from Example A based on carrageenan and zeolite were added to Wisk® laundry detergents; within 20 minutes at room temperature, all the particles sank to the bottom of the container.

Example 17

Example 17 shows the absorbance of Henkel Persil Color Gel—a thick HDL from Henkel—versus a formula of the current invention (Note: Henkel Gel is blue in color so the red end of the visible spectrum was used as to not have absorbance from the blue dye):

TABLE 6

Transmittance calculation for Owen samples

| Wavelength | Henkel Persil Color Gel | | 1 | 1 | 13 | 13 |
|---|---|---|---|---|---|---|
| Example | Absorbance | Transmittance, % | Absorbance | Transmittance, % | Absorbance | Transmittance, % |
| 570 | 1.36 | 4.37 | 0.011 | 97.50 | 0.082 | 82.79 |
| 590 | 1.54 | 2.88 | 0.01 | 97.72 | 0.068 | 85.51 |
| 610 | 1.74 | 1.82 | 0.009 | 97.95 | 0.061 | 86.90 |
| 630 | 2.1 | 0.79 | 0.009 | 97.95 | 0.057 | 87.70 |
| 670 | 1.36 | 4.37 | 0.008 | 98.17 | 0.052 | 88.72 |
| 690 | 1.15 | 7.08 | 0.007 | 98.40 | 0.047 | 89.74 |

As can be seen from the results, Henkel Persil Color Gel has higher absorbance values than the inventive formulation. This indicates that the structuring mechanism is quite different than in our case. Further, 600 micron sized particles based on carrageenan and zeolite were added to a Henkel WIIPP gel detergent (different than the Henkel Persil above) and within 20 minutes, all the particles sank to the bottom of the container.

What is claimed is:

1. A process for making a stable shear-thinning, transparent or translucent liquid laundry detergent composition, the composition comprising:

(a) about 0.01 to 5% by wt. of a polymer gum or polymer gums capable of forming stable, non-continuous networks selected from the group of gums consisting of agar, gelatin, rhamsan, gellan and furcellaran wherein said stable, non-continuous network can suspend particles having a size of 300 to 5000 microns;

(b) 15 to 85% by wt. of a surfactant;

(c) an alkalinity buffer;

wherein by shear thinning is meant being able to support particles 300 to 5000 microns in size while having a pour viscosity of about 50 to about 3000 cps measured at $21S^{-1}$ at about room temperature;

wherein by stable is meant particles do not phase separate for at least 2 weeks when measured at room temperature;

wherein said process comprises:

(i) mixing about 0.01 to 5% by wt. of a gum premix of said gum polymer or polymers with balance water at a temperature of about room temperature to about 200° F. for at least 30 minutes or until gum is swollen to form a polymer gum premix having concentration about 0.001 to 5% by wt. composition;

(ii) promoting formation of gum bits from said premix by agitating the premix and additionally selecting a method selected from the group consisting of addition of counterion, use of temperature differential and mixtures thereof; and (iii) separately preparing a liquid detergent base comprising the surfactant which is subsequently combined with the gum bits formed in step (ii) to form a final detergent composition comprising suspending gum bits.

2. A process according to claim 1, wherein the composition has a pour viscosity, measured by shear rate of $21S^{-1}$ at room temperature of 100 to 2000 cps.

3. A process according to claim 1, wherein at a wavelength of 410–800 nanometers said composition has 50% transmittance of light using a 1 centimeter cuvette wherein said composition is measured free of any dyes.

4. A process according to claim 1, wherein the surfactant amount is 20% to 85% by wt.

5. A process according to claim 1, wherein the surfactant amount is 21% to 80% by wt.

6. A composition according to claim 1, wherein polymer is geletin.

7. A process according to claim 1, comprising 0.1 to 10% by wt. particles having size of 300 to 5000 microns.

8. A process according to claim 1, wherein the surfactant comprises 5% to 50% by wt. nonionic surfactant.

9. A process according to claim 8, wherein the surfactant comprises 10 to 40% by wt. nonionic surfactant.

10. A composition according to claim 1, wherein pour viscosity is 150 to 1500 cps at $21S^{-1}$.

11. A process for making a stable shear-thinning, transparent or translucent liquid laundry detergent composition, the composition comprising:

(a) about 0.01 to 5% by wt. of a polymer gum or polymer gums capable of forming stable, non-continuous networks selected from the group of gums consisting of agar, gelatin, rhamsan, gellan and furcellaran wherein said stable, non-continuous network can suspend particles having a size of 300 to 5000 microns;

(b) 15 to 85% by wt. of a surfactant;

(c) an alkalinity buffer;

wherein by shear thinning is meant being able to support particles 300 to 5000 microns in size while having a pour viscosity of about 50 to about 3000 cps measured at $21S^{-1}$ at about room temperature;

wherein by stable is meant particles do not phase separate for at least 2 weeks when measured at room temperature;

wherein said process comprises:

(i) mixing about 0.01 to 5% by wt. of a gum premix of said gum polymer or polymers with balance water at a temperature of about room temperature to about 200° F. for at least 30 minutes or until gum is swollen to form a polymer gum premix having concentration about 0.001 to 5% by wt. composition;

(ii) contacting a fully formed liquid detergent base or detergent base components comprising the surfactant with gum premix of (i) to form a final detergent composition comprising surfactant polymer bits formed in-situ.

* * * * *